US006625820B1

(12) United States Patent
Lampe

(10) Patent No.: US 6,625,820 B1
(45) Date of Patent: Sep. 30, 2003

(54) PROTECTIVE HEADGUARD

(75) Inventor: John K. Lampe, St. Paul, MN (US)

(73) Assignee: Affinity Soccer, Inc, San Diego, CA (US)

( * ) Notice: Subject to any disclaimer, the term of this patent is extended or adjusted under 35 U.S.C. 154(b) by 106 days.

(21) Appl. No.: 09/843,280

(22) Filed: Apr. 24, 2001

Related U.S. Application Data

(60) Provisional application No. 60/199,166, filed on Apr. 24, 2000.

(51) Int. Cl.[7] ..... A63B 71/10; A42B 3/00

(52) U.S. Cl. ..... 2/425; 2/411; 2/171

(58) Field of Search ..... 2/411, 425, 171, 2/414, 412, DIG. 11

(56) References Cited

U.S. PATENT DOCUMENTS

| | | | | |
|---|---|---|---|---|
| 532,567 | A | 1/1895 | Larwood, Jr. | |
| 1,209,093 | A | 12/1916 | Whitlow | |
| 2,391,335 | A | 12/1945 | O'Brien | 2/3 |
| 2,969,547 | A | 1/1961 | Dye | |
| 3,159,160 | A | 12/1964 | Ullom | 128/97 |
| 3,171,133 | A | 3/1965 | Steffen | |
| 3,725,956 | A | 4/1973 | Reisen | 2/200 |
| 3,784,984 | A | 1/1974 | Aileo | 2/3 |
| 3,992,721 | A | 11/1976 | Morton | 2/3 |
| 4,023,209 | A | 5/1977 | Frieder, Jr. et al. | 2/6 |
| 4,044,400 | A | 8/1977 | Lewicki et al. | 2/421 |
| 4,058,854 | A | 11/1977 | Rhee | 2/412 |
| 4,062,067 | A | 12/1977 | Franzen | 2/410 |
| 4,075,717 | A | 2/1978 | Lemelson | 2/412 |
| 4,204,543 | A | 5/1980 | Henderson | 128/402 |
| 4,239,106 | A | 12/1980 | Aileo | 206/223 |
| 4,290,149 | A | 9/1981 | Aileo | 2/414 |
| 4,317,239 | A | 3/1982 | Bryksa | 2/411 |
| 4,345,336 | A | 8/1982 | Plastino | 2/187 |
| 4,354,284 | A | 10/1982 | Gooding | 2/413 |
| 4,398,306 | A | 8/1983 | Gooding | 2/421 |
| 4,404,690 | A | 9/1983 | Farquharson | 2/420 |
| 4,443,891 | A | 4/1984 | Blomgrenetal | 2/414 |
| 4,481,681 | A | 11/1984 | Hankin | 2/197 |
| 4,484,364 | A | 11/1984 | Mitchel et al. | 2/412 |
| 4,539,715 | A | 9/1985 | Clement | 2/420 |
| 4,558,470 | A | 12/1985 | Mitchell et al. | 2/413 |
| 4,581,773 | A | 4/1986 | Cunnane | 2/204 |
| 4,612,672 | A | 9/1986 | Schrack | 2/68 |
| 4,613,993 | A | 9/1986 | Steele et al. | 2/411 |
| 4,646,367 | A | 3/1987 | El Hassen | 2/411 |
| 4,698,852 | A | 10/1987 | Romero | 2/171 |
| 4,706,305 | A | 11/1987 | Cho | 2/425 |
| 4,710,985 | A | 12/1987 | Dubner et al. | 2/425 |
| 4,766,614 | A | 8/1988 | Cantwell et al. | 2/414 |
| 4,768,231 | A | 9/1988 | Schrack | 2/12 |
| 4,790,035 | A | 12/1988 | Whyte | 2/207 |

(List continued on next page.)

FOREIGN PATENT DOCUMENTS

| | | | |
|---|---|---|---|
| DE | 10003125 A1 * | 8/2001 | A63B/71/10 |
| FR | 2 390 116 | 5/1977 | A41D/21/00 |
| GB | 2 202 729 A | 10/1988 | A42B/3/00 |
| GB | 2 318 500 A | 4/1998 | A63B/71/10 |
| GB | 2 333 690 A | 8/1999 | A63B/71/10 |
| WO | WO 88/04188 | 6/1988 | A63B/71/10 |
| WO | WO 99/29199 | 6/1999 | A42B/3/00 |

OTHER PUBLICATIONS

Seven Photographs of "Gilbert Rugby"Protective Headgear.
Seven Photographs of "CCC" Protective Headgear.
"Can Sports–Minded Kids Have Too Many Helmets?" Thomas B. Cole, JAMA, vol. 275, No. 8, May 8, 1996.
"Head and Neck Injuries in Soccer" Alf Thorvald Tysvaer, 1992.

*Primary Examiner*—Rodney M. Lindsey
(74) *Attorney, Agent, or Firm*—Sherrill Law Offices, PLLC

(57) ABSTRACT

Protective headguards comprising a front panel, a rear panel, and a means for releasably connecting the lateral ends of the front and rear panels. At least one and preferably both of the front and rear panels comprise layers of at least a shell, a shock absorbing liner and a comfort liner.

44 Claims, 11 Drawing Sheets

U.S. PATENT DOCUMENTS

| | | | | |
|---|---|---|---|---|
| 4,827,537 | A | 5/1989 | Villa | 2/410 |
| 4,843,642 | A | 7/1989 | Brower | 2/6 |
| 4,847,921 | A | 7/1989 | Leutholt et al. | 2/425 |
| 4,854,319 | A | 8/1989 | Tobin | 128/380 |
| 4,864,662 | A | 9/1989 | Frank | 2/183 |
| 4,910,804 | A | 3/1990 | Lidgren | 2/209.3 |
| 4,947,480 | A | 8/1990 | Ashinoff | 2/181 |
| 4,982,451 | A | 1/1991 | Graham | 2/410 |
| 5,012,533 | A | 5/1991 | Raffler | 2/420 |
| 5,042,093 | A | 8/1991 | Legendre | 2/419 |
| 5,044,016 | A | 9/1991 | Coombs | 2/414 |
| 5,075,903 | A | 12/1991 | Richoux | 2/411 |
| 5,081,717 | A | 1/1992 | Shedd et al. | 2/199 |
| 5,083,321 | A | 1/1992 | Davidsson | 2/421 |
| 5,173,970 | A | 12/1992 | Shifrin | 2/410 |
| 5,177,815 | A | 1/1993 | Andujar | 2/411 |
| 5,184,354 | A | 2/1993 | Alfaro et al. | 2/425 |
| 5,197,292 | A | 3/1993 | McPherson | 62/56 |
| D339,677 | S | 9/1993 | Xang | D2/512 |
| 5,271,103 | A | 12/1993 | Darnell | 2/418 |
| 5,315,718 | A | 5/1994 | Barson et al. | 2/418 |
| 5,337,420 | A | 8/1994 | Haysom et al. | 2/410 |
| 5,361,420 | A | 11/1994 | Dobbs et al. | 2/425 |
| 5,392,468 | A | 2/1995 | Leddick III | 2/424 |
| 5,421,035 | A | 6/1995 | Klose et al. | 2/411 |
| 5,437,064 | A | 8/1995 | Hamaguchi | 2/414 |
| 5,450,631 | A | 9/1995 | Egger | 2/425 |
| 5,504,945 | A | 4/1996 | Purnell | 2/425 |
| 5,511,250 | A | 4/1996 | Field et al. | 2/418 |
| D370,309 | S | 5/1996 | Stucky | D29/102 |
| 5,515,546 | A | 5/1996 | Shifrin | 2/410 |
| 5,519,895 | A | 5/1996 | Barnes, Jr. | 2/422 |
| 5,535,454 | A | 7/1996 | Ryan | 2/425 |
| 5,539,934 | A | 7/1996 | Ponder | 2/410 |
| 5,544,367 | A | 8/1996 | March, II | 2/410 |
| 5,551,094 | A | 9/1996 | Navone | 2/421 |
| 5,557,807 | A | 9/1996 | Hujar et al. | 2/171.2 |
| 5,615,419 | A | 4/1997 | Williams | 2/411 |
| 5,628,071 | A | 5/1997 | Nezer | 2/410 |
| 5,638,551 | A | 6/1997 | Lallemand | 2/421 |
| 5,640,721 | A | 6/1997 | Jackson | 2/171 |
| 5,659,900 | A | 8/1997 | Arney et al. | 2/417 |
| 5,661,854 | A | 9/1997 | March, II | 2/410 |
| 5,680,656 | A | 10/1997 | Gath | 2/424 |
| 5,701,609 | A | 12/1997 | Bridges | 2/422 |
| 5,704,072 | A | 1/1998 | Garneau | 2/421 |
| 5,774,901 | A | 7/1998 | Minami | 2/421 |
| 5,790,988 | A | 8/1998 | Guadagnino, Jr. et al. | 2/411 |
| 5,815,847 | A | 10/1998 | Holden, Jr. | 2/418 |
| 5,826,277 | A | 10/1998 | McConville | 2/171 |
| 5,862,528 | A | 1/1999 | Saijo et al. | 2/411 |
| 5,882,205 | A | 3/1999 | Peterson | 434/251 |
| D410,768 | S | 6/1999 | Hirsh | D29/102 |
| 5,926,849 | A | 7/1999 | Boyle | 2/181.8 |
| 5,930,841 | A | 8/1999 | Lampe et al. | 2/411 |
| 5,946,734 | A | 9/1999 | Vogan | 2/412 |
| 5,963,989 | A | 10/1999 | Robertson | 2/411 |
| 6,000,062 | A | 12/1999 | Trakh | 2/171 |
| 6,065,159 | A | 5/2000 | Hirsh | 2/425 |
| 6,266,827 | B1 | 7/2001 | Lampe et al. | 2/414 |
| 6,339,849 | B1 * | 1/2002 | Nelson et al. | 2/425 |
| 6,349,416 | B1 | 2/2002 | Lampe et al. | 2/411 |
| 6,381,760 | B1 * | 5/2002 | Lampe et al. | 2/425 |
| 6,397,399 | B1 * | 6/2002 | Lampe et al. | 2/425 |
| 6,421,840 | B1 * | 7/2002 | Chen et al. | 2/411 |
| 6,438,761 | B1 * | 8/2002 | McGarrity | 2/171 |
| 6,490,730 | B1 * | 12/2002 | Lyden | 2/22 |

* cited by examiner

PROTECTIVE HEADGUARD

This application claims the benefit of U.S. Provisional Application No. 60/199,166, filed Apr. 24, 2000.

FIELD OF INVENTION

The present invention generally relates to protective headguards for athletics and, more particularly, relates to a protective headguard for protecting a wearer from blunt impacts to the side of the head, such as a head impact with the ground resulting from a slip or fall.

BACKGROUND OF THE INVENTION

Participants in many sports are increasingly using protective headgear of various kinds. Football players have long worn helmets to protect themselves from blows to the head and face. Sometime later hockey players also began to protect themselves with helmets. More recently recreational bicyclists have perceived the need to use protective headgear and have started to wear helmets in increasing numbers.

Traditionally, athletes in other sports, such as basketball, figure skating and soccer have not worn any protective headgear. This is probably because the players and organizers of these games have not sensed a need to use headgear because injuries to the head are not as commonplace as in sports such as football, hockey, and bicycling. However, studies are beginning to suggest that head injuries are more prevalent in a number of sports, including basketball, figure skating and soccer, than previously thought. The danger of trauma resulting from such head injuries may be greater for children. Therefore, at least from a safety standpoint, use of protective headgear by athletes participating in such sports, especially children, seems advisable.

Protective headgear designed for maximum impact protection generally employ a shock absorbing liner constructed from a material having a high plasticity. Plasticity is a physical property which allows a material to collapse upon impact so as to internally absorb at least a portion of an impact.

In order to allow materials to regain their shape after deformation, such materials must have a level of elasticity. Elasticity is a physical property which allows a material to return towards its original size and shape after deformation. While the use of highly elastic materials in the construction of shock absorbing liners allows continued use of the shock absorbing liner after an initial impact, as a general rule an increase in the elasticity of a material corresponds to a decrease in the plasticity of the material.

Certain sports, such as motorsports and bicycling where the force of a typical impact is very high but the frequency of impacts is generally low, protective headgear tends to utilize liners constructed from a material having high plasticity and low elasticity. This allows the protective headgear to protectively absorb the high impact of a crash, but requires that the protective headgear be replaced after each impact.

Other sports, such as football, hockey, and lacrosse where the force of a typical impact is fairly modest but the frequency of such impacts is generally high, protective headgear tends to utilize liners constructed from a plastic material having high elasticity. This allows the protective headgear to protectively absorb the modest but repeated impacts encountered in such sports without requiring disposal of the protective headgear after each impact.

Another guiding principle in the design of protective headgear is the ability to increase the protective value of headgear by increasing the area of contact between the headgear (i.e., the shock absorbing liner) and the head. Generally, the amount of impact generated kinetic energy which can be absorbed by a shock absorbing liner increases as the area of contact with the head increases. However, due to the necessary rigidity of typical protective headgear, it is often difficult to achieve a large area of contact between the shock absorbing liner and the head. Such rigidity also makes it difficult to obtain comfortably fitting off-the-shelf protective headgear.

Accordingly, a need exists for protective headgear having a high area of contact between the shock absorbing liner and the head which can be comfortably fitted when purchased as an off-the-shelf product and can be reused after impact.

SUMMARY OF THE INVENTION

Generally, the present invention relates to improvements to a headguard for athletes. The protective headguard, comprises (i) a front panel, (ii) a rear panel, and (iii) a means for releasably connecting the lateral ends of the front and rear panels. At least one and preferably both of the front and rear panels comprise layers of at least a shell, a shock absorbing liner and a comfort liner. When the lateral ends of the front and rear panels are connected and the headguard is worn, the front panel covers at least the forehead of the wearer and the rear panel covers at least the occipital bone of the wearer, while the crown portion of the wearer's head remains uncovered.

The above summary of the present invention is not intended to describe each illustrated embodiment of the present invention. The figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings.

Figure 1:
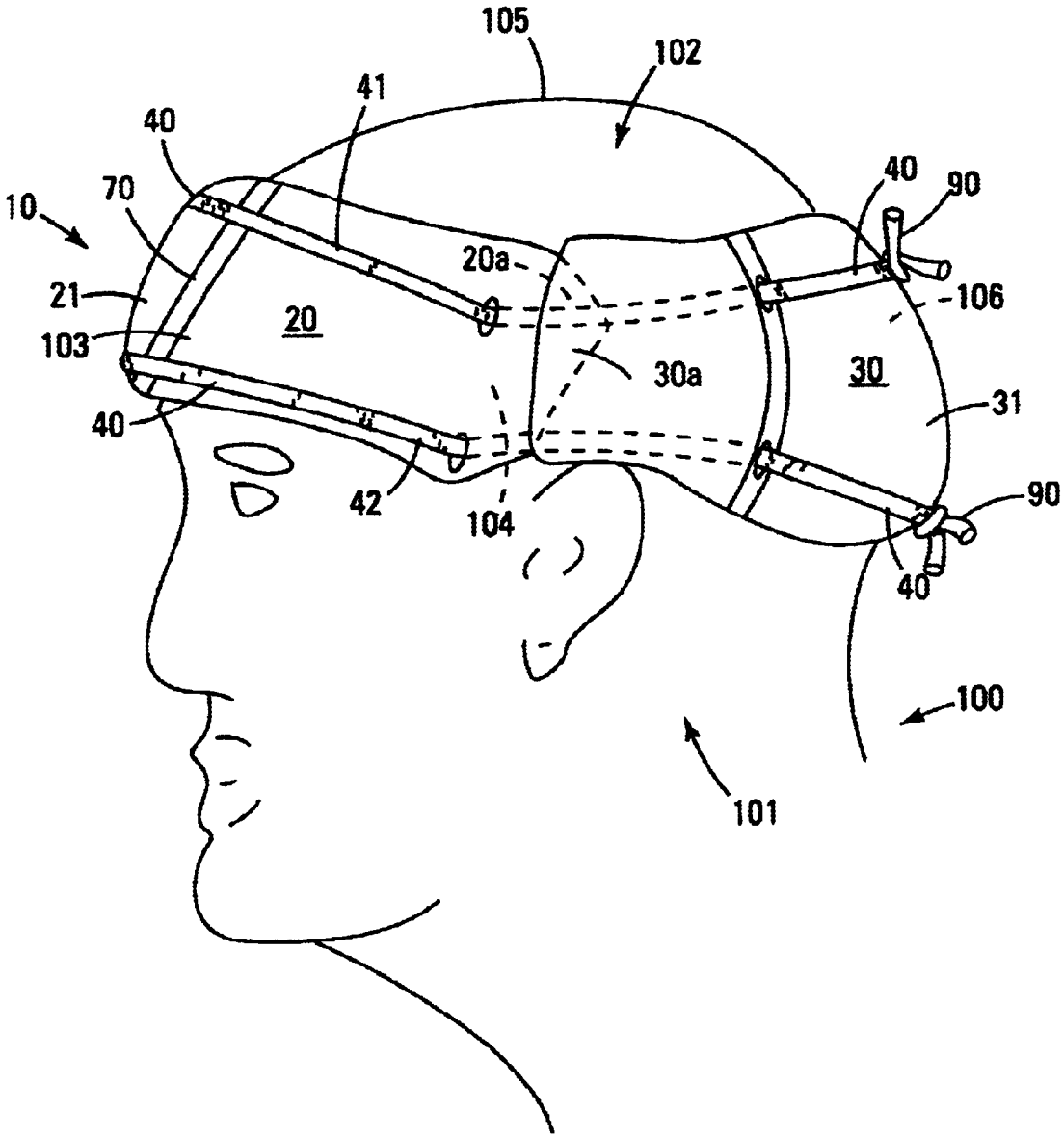
FIG. 1 is a side view of one embodiment of the headgear worn by a wearer.

While the invention is amenable to various modifications and alternative forms, specifics thereof have been shown by way of example in the drawings and will be described in detail. It should be understood, however, that the intention is not to limit the invention to the particular embodiments described, although all embodiments described are intended to fall within the claims of this invention. On the contrary, the intention is to cover all modifications, equivalents, and alternatives falling within the spirit and scope of the invention as defined by the appended claims.

DETAILED DESCRIPTION OF THE INVENTION INCLUDING A BEST MODE

NOMENCLATURE

10 Headguard
20 Front Panel
20*a* First Lateral End of Front Panel
20*b* Second Lateral End of Front Panel
21 Shell of Front Panel
22 Shock Absorbing Liner of Front Panel 22*g* Gel
22*p* Pouch
23 Comfort Liner of Front Panel
23*p* Pockets in Comfort Liner
23*t* Tabs Extending from Comfort Liner of Front Panel
30 Rear Panel
30*a* First Lateral End of Rear Panel
30*b* Second Lateral End of Rear Panel
31 Shell of Rear Panel
32 Shock Absorbing Liner of Rear Panel
32*g* Gel
32*p* Pouch
33 Comfort Liner of Rear Panel
33*t* Tabs Extending from Comfort Liner of Rear Panel
40 Adjustment Straps
41 Upper Adjustment Strap System
42 Lower Adjustment Strap System
50 Hook and Loop Strips
60 Chin Strap
70 Conforming Channels
80 Guide Channels
90 Fastener
100 Wearer
101 Head of Wearer
102 Top Portion of Wearer's Head
103 Forehead of Wearer
104 Sides of Wearer's Head
105 Crown of Wearer's Head
106 Back of Wearer's Head

Construction and Use

Generally, the present invention relates to an improved headguard 10 for athletes. The protective headguard 10 includes a front panel 20, a rear panel 30 and a means 40 for releasably connecting the lateral ends 20*a*, 20*b*, 30*a* and 30*b* of the front 20 and rear 30 panels respectively. At least one and preferably both of the front 20 and rear 30 panels comprise layers of at least a shell 21, 31, a shock absorbing liner 22, 32 and a comfort liner 23, 33.

Figure 2:
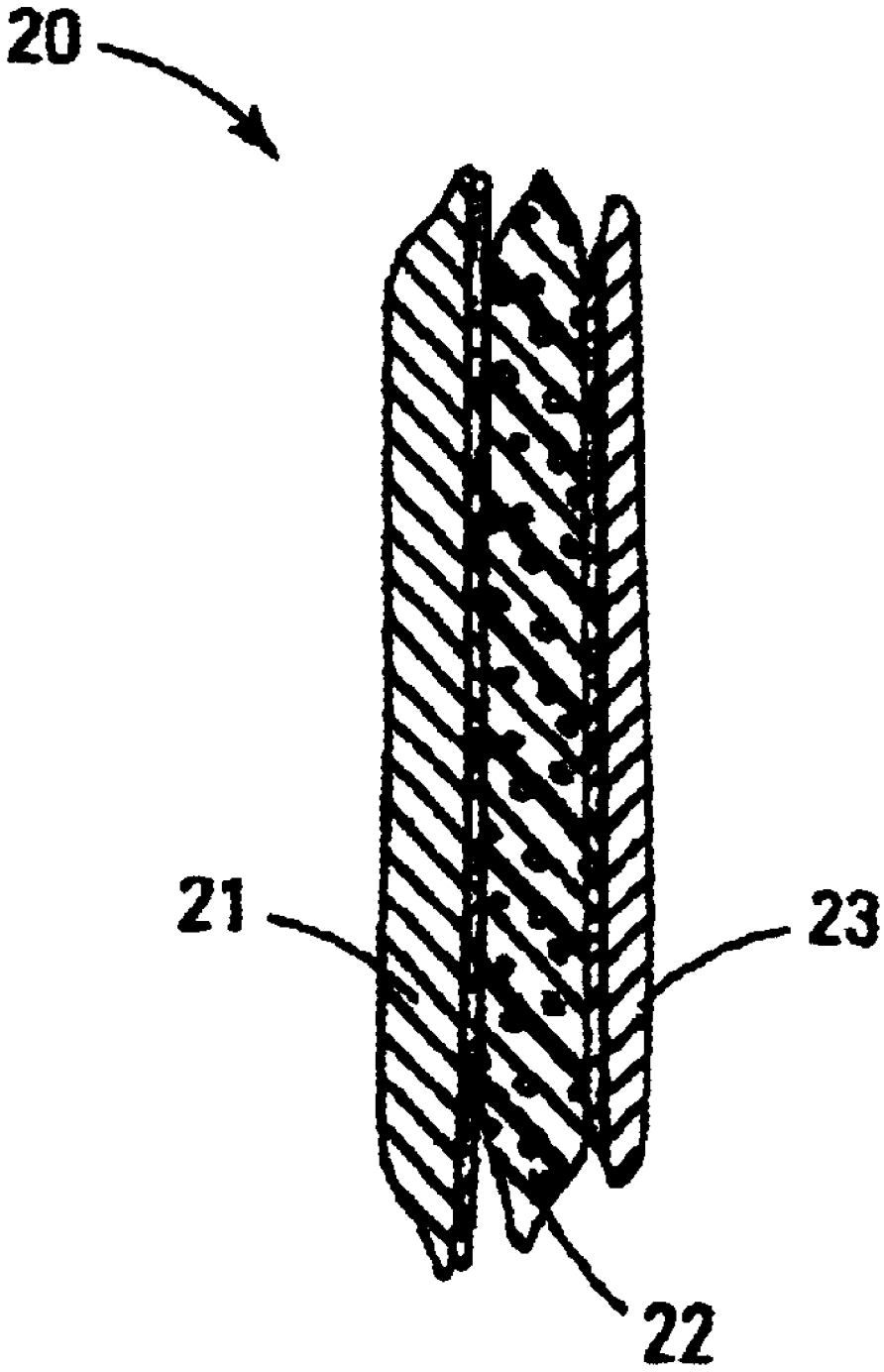
FIG. 2 is a cross-sectional side view of the front panel of the headgear shown in FIG. 1.

As shown in FIG. 1, the headguard 10 includes a front panel 20 and a rear panel 30. In the embodiment shown in FIG. 1, the lateral edges 30*a* and 30*b* of the rear panel 30 overlaps the lateral edges 20*a* and 20*b* of the front panel 20 respectively. As shown in FIG. 2, the front panel 20 consists of an exterior shell 21, a shock absorbing liner 22, and a removable comfort liner 23. The rear panel 30 is also preferably constructed with an exterior shell 31, a shock absorbing liner (not shown) and a comfort liner (not shown) similar to the front panel 20.

Figure 3:
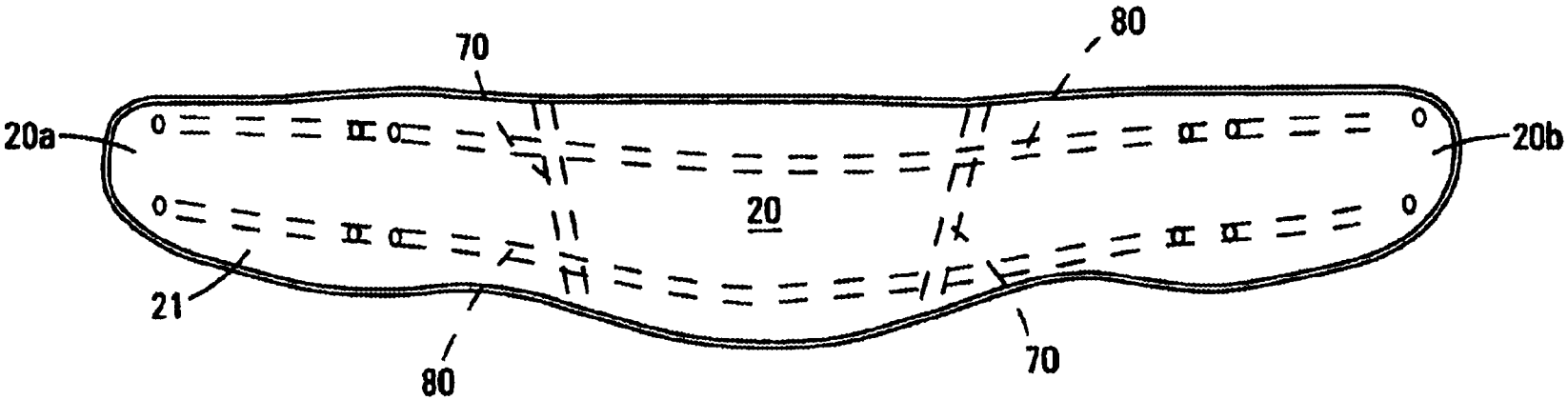
FIG. 3 is an interior view of the front panel of the headgear shown in FIG. 1 prior to shaping of the front panel.

The shell 21 and 31 may be made from any number of suitable materials well known to those skilled in the art. A pliable foam is preferred. Most preferred is a pliable material with a ductility which allows the material to be readily shaped by hand to conform to the irregular contours of each human head 101. Construction of the shell 21 and/or 31 from such a ductile material permits the shell 21 and/or 31 to be molded as a flat form as shown in FIG. 3. The flat shell 21 and/or 31 can be shaped after purchase by a wearer 100, by simply positioning the headguard 10 onto his/her head 101 and then pressing the shell 21 and/or 31 against their head 101 with their hands (not shown). Construction of the shell 21 and/or 31 from such a ductile material serves to maximize the surface area of the headgear 10 in contact with a wearer's head 101 and thereby increase the amount of kinetic energy absorbed by the headguard 10 upon impact with a blunt object.

The shell 21 and/or 31 may also be constructed from stiffer, less ductile material. When such material is employed, the conformability of the shell 21 and/or 31 may be enhanced by creating conforming channels 70 in the shell 21 and/or 31 in those locations where enhanced flexing is desired. Conforming channels 70 can be formed by simply creating linear areas of the shell 21 and/or 31 which are thinner than the balance of the shell 21 and/or 31. Conforming channels 70 increase the flexibility of the shell 21 and/or 31 generally in the direction perpendicular to the direction of the conforming channels 70. The conforming channels 70 effectively function as live hinges by increasing the ability of the shell 21 and/or 31 to flex and curve along the conforming channels 70 and thereby conform to the shape of the head 101. Multiple, closely spaced, parallel conforming channels 70 may be employed when a significant increase in flexibility and conformability of the shell 21 and/or 31 is desired without creating a line of significant weakness.

The conforming channels 70 preferably run at an angle of between about 45° to 90° relative to the bottom or top edges (unnumbered) of the shell 21 and/or 31 (i.e., biased in the vertical direction) thereby increasing the ability of the panels 20 and 30 to wrap around a wearer's head 101.

Figure 12:
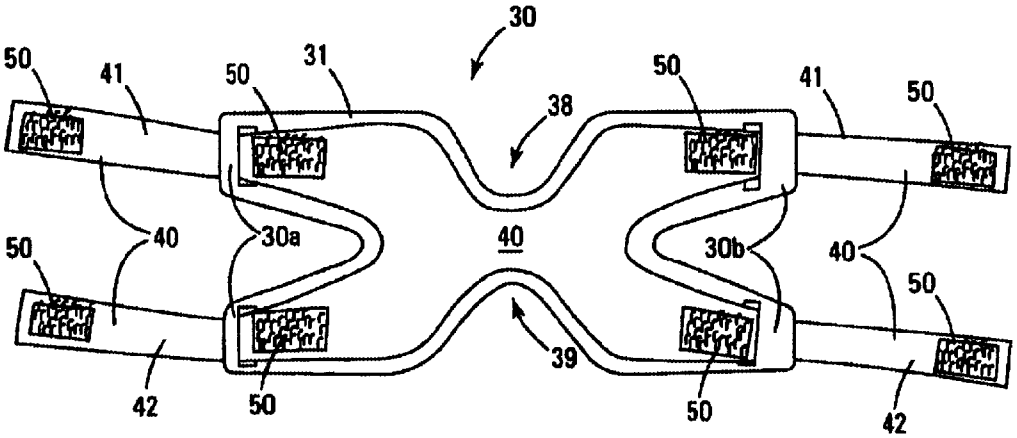
FIG. 12 is an exterior view of one embodiment of a rear panel with an adjustment strap.

The conforming channels 70 are preferably molded into the exterior surface (unnumbered) of the shells 21 and/or 31 at points where the shells 21 and/or 31 must curve most severely in order to conform to the shape of a wearer's head 101. For example, as shown in FIGS. 1, 3 and 12, substantially vertical conforming channels 70 may usefully be located in the front shell 21 along that portion of the front panel 20 which would rest on the part of a wearer's head 101 that forms the transition from the forehead 103 to the side of the head 104.

As shown in FIG. 3, guide channels 80 may be molded into the exterior surface (unnumbered) of the front 20 and/or rear 30 panels for purposes of guiding and retaining the adjustment straps 40 when the adjustment straps 40 extend completely around the front 20 and/or rear 30 panels.

Figure 5:
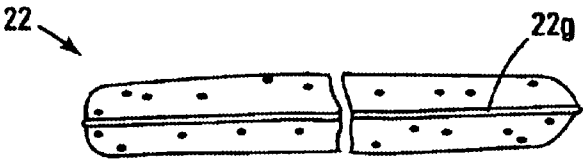
FIG. 5 is a side view of the shock absorbing liner shown in FIG. 4.
Figure 8:
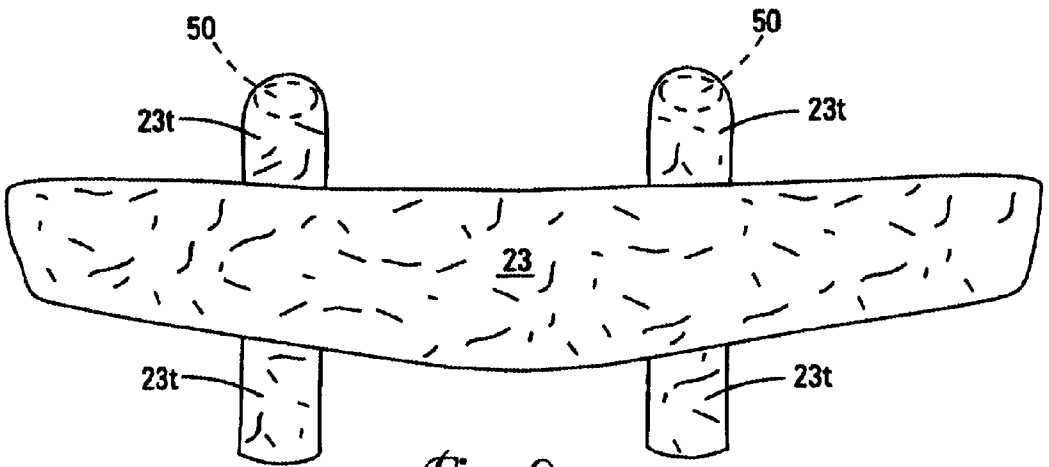
FIG. 8 is an interior view of a second embodiment of a comfort liner.

A shock absorbing liner 22 and/or 32 is positioned interior to the shell 21 and/or 31 of the front 20 and/or rear 30 panels respectively. The shock absorbing liner 22 and/or 32 may be made from any of the various shock absorbing or dampening material known to those skilled in the art, including foams and gels. As shown in FIG. 5, a preferred shock absorbing liner 22 and/or 32 is a pouch 22*p* and/or 32*p* containing a shock absorbing gel 22*g* or 32*g* respectively. The pouch 22*p* and/or 32*p* may be made of polyurethane. Preferably, the pouch 22*p* and/or 32*p* has a wall thickness (unnumbered) of less than 1 mm, most preferably less than 400 micrometers, in order to enhance the shock attenuation provided by the gel 22*g* and/or 32*g*.

Figure 4:
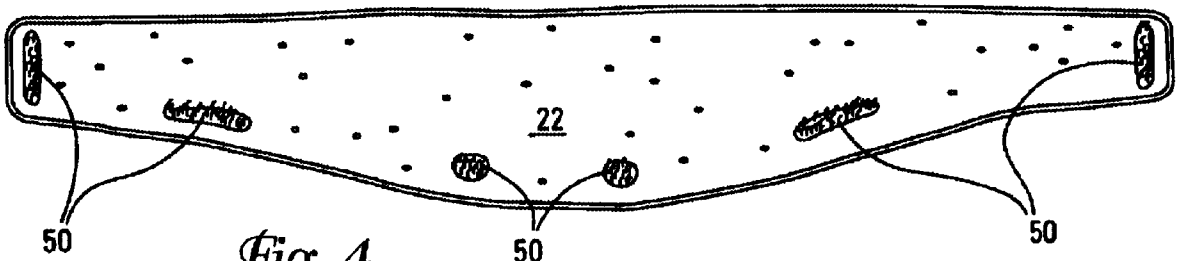
FIG. 4 is an exterior view of one embodiment of a shock absorbing liner.

As shown in FIG. 4, use of a gel filled pouch as the shock absorbing liner 22 and/or 32 eliminates the need to employ conforming channels or other similar mechanisms in order to break the shock absorbing liner 22 and/or 32 into sections or cells in order to allow the shock absorbing liner 22 and/or 32 to closely conform to a wearer's head 101. The gel 22*g* and/or 32*g* inherently conforms to the shape of a wearer's head and the thin walls of the pouch 22*p* and/or 32*p* allows the gel 22*g* and/or 32*g* to conform with limited restriction. By eliminating the need for separate sections or cells in the shock absorbing liner 22 and/or 32, the surface area of the shock absorbing liner 22 and/or 32 in contact with a wearer's head 101 is further increased.

A suitable thin film for use in construction of the pouch 22*p* and/or 32*p* is disclosed in U.S. Pat. No. 5,988,388, which disclosure is hereby incorporated by reference. Use of such a thin film allows the pouch 22*p* and/or 32*p* to stretched over a rounded area with the exterior film wall stretching while the interior wall bunches in small ripples. By keeping the ripples small the amount of surface area which loses contact with the head of a wearer 101 is minimized and improved fit, comfort and impact protection is achieved.

The thickness of the shock absorbing liner 22 and/or 32 can be varied depending upon the specific activity to which the headguard 10 is directed. Generally, a thickness of between 3 mm and 25 mm will be suitable for most uses.

In order to decrease the density of the gel 22*g* and/or 32*g* without a significant loss in the shock absorptive capacity of the gel 22*g* and/or 32*g*, air bubbles or other similar lightweight materials may be introduced into the gel 22*g* and/or 32*g*.Such a bubbled gel material is disclosed in U.S. Pat. No. 5,667,895, the disclosure of which is hereby incorporated by reference.

The comfort liners 23 and 33 may be made from any number of suitable materials well known to those skilled in the art. The comfort liners 23 and 33 are preferably made from an open-cell foam with fabric laminated to the surface. The comfort liners 23 and 33 may cover various parts of a wearer's head 101, with the comfort liner 23 of the front panel 20 covering all or any portion of the forehead 103 and sides 104 of a wearer's head 101 and the comfort liner 33 of the rear panel 30 covering all or any portion of the sides 104 and back 106 of a wearer's head 101.

The shell 21 and 31, shock absorbing liner 22 and 32, and comfort liner 23 and 33 of the front panel 20 and the rear panel 30 respectively, may be attached to each other in any of a number of ways, including specifically but not exclusively hook and loop tape, and adhesive. By way of example, FIGS. 2 and 4 depict (i) lamination of a loop fabric to the entire interior surface of the shell 21 with the hook half of hook and loop tape 50 glued at strategic locations on the exterior surface of the shock absorbing liner 22, and (ii) lamination of a loop fabric to the entire exterior surface of the comfort liner 23 with the hook half of hook and loop tape 50 again glued at strategic locations on the interior surface of the shock absorbing liner 22.

Figure 6:
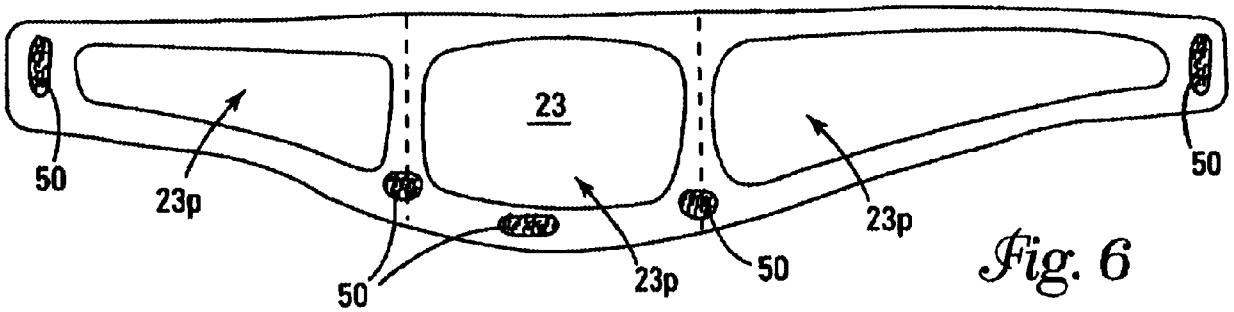
FIG. 6 is a front view of one embodiment of a comfort liner.
Figure 7:
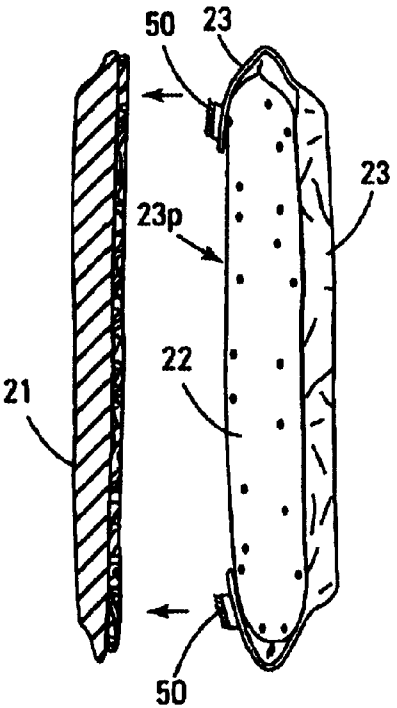
FIG. 7 is a cross-sectional side view of the comfort liner of FIG. 6 containing a shock absorbing liner and depicting attachment of the comfort liner to a shell.
Figure 9:
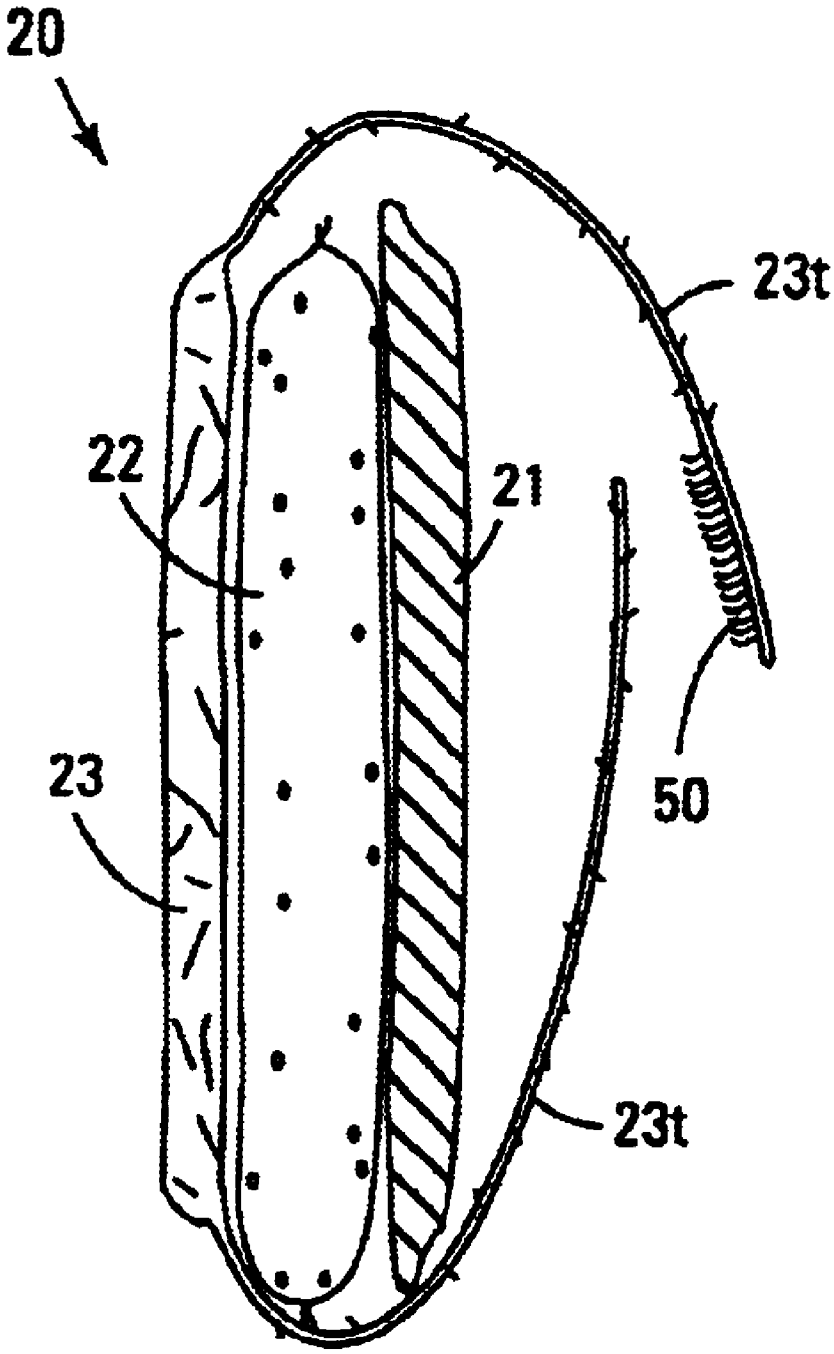
FIG. 9 is a cross-sectional side view of the comfort liner of FIG. 8 interconnecting the comfort liner to a shock absorbing liner and a shell.

An alternative embodiment, shown in FIGS. 6 and 7, involves the insertion of gel-filled shock absorbing pouches 22*p* and/or 32*p* into pockets 23*p* and/or 32*p* created in the exterior surface of the comfort liner 23 or 33. The comfort liner 23 or 33 can then be attached to the shell 21 and/or 31 using hook and loop tape 50 so as to sandwich the shock absorbing pouches 22*p* and/or 32*p* between the comfort liner 23 and/or 33 and the shell 21 and/or 31.

The comfort liner 23 and/or 33 can have a plurality of pockets 23*p* and/or 33*p* for accommodating several smaller shock absorbing pouches 22*p* and/or 32*p*, or a single pocket 23*p* and/or 33*p* with cross supports for accommodating a single unitary shock absorbing pouch 22*p* and/or 32*p*.

Still another embodiment, shown in FIGS. 8, 9, 10, and 11, includes longitudinally extending tabs 23*t* and/or 33*t* extending from the comfort liner 23 and/or 33. The tabs 23*t* and/or 33*t* are wrapped around the shell 21 and/or 31 with longitudinally opposed tabs 23*t* and/or 33*t* secured together with hook and loop tape 50.

Figure 16:
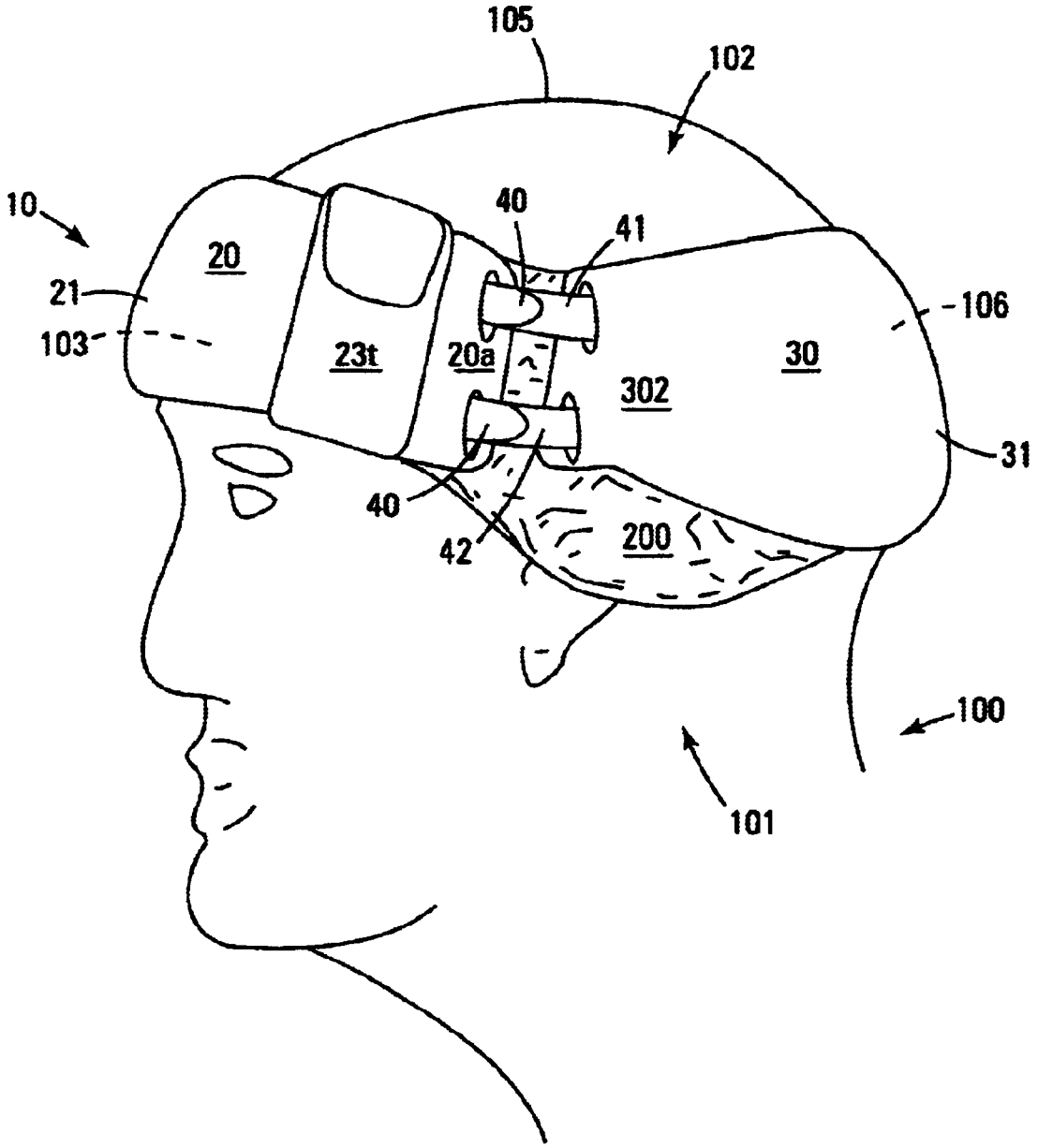
FIG. 16 is a side view of a fifth embodiment of the headgear worn by a wearer.

As shown in FIG. 16, the comfort liner 33 of the rear panel 30 can be configured and arranged to include a downwardly extending flap 35 effective for covering the ears (unnumbered) of a wearer 100 for warmth.

Figure 14:
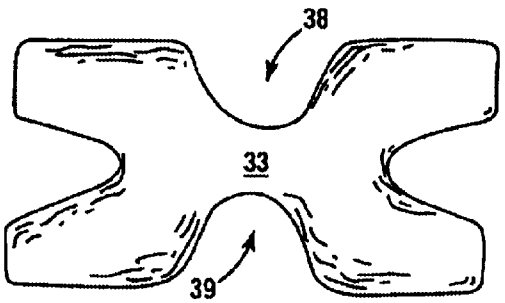
FIG. 14 is an exterior view of a comfort liner for use in combination with the rear panel shown in FIG. 12 and the shock absorbing liner of FIG. 13.
Figure 13:
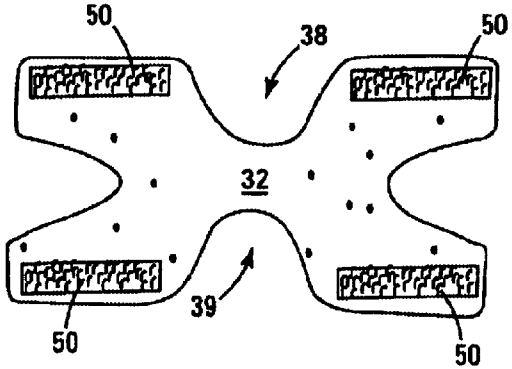
FIG. 13 is an exterior view of a shock absorbing liner for use in combination with the rear panel shown in FIG. 12.
Figure 15:
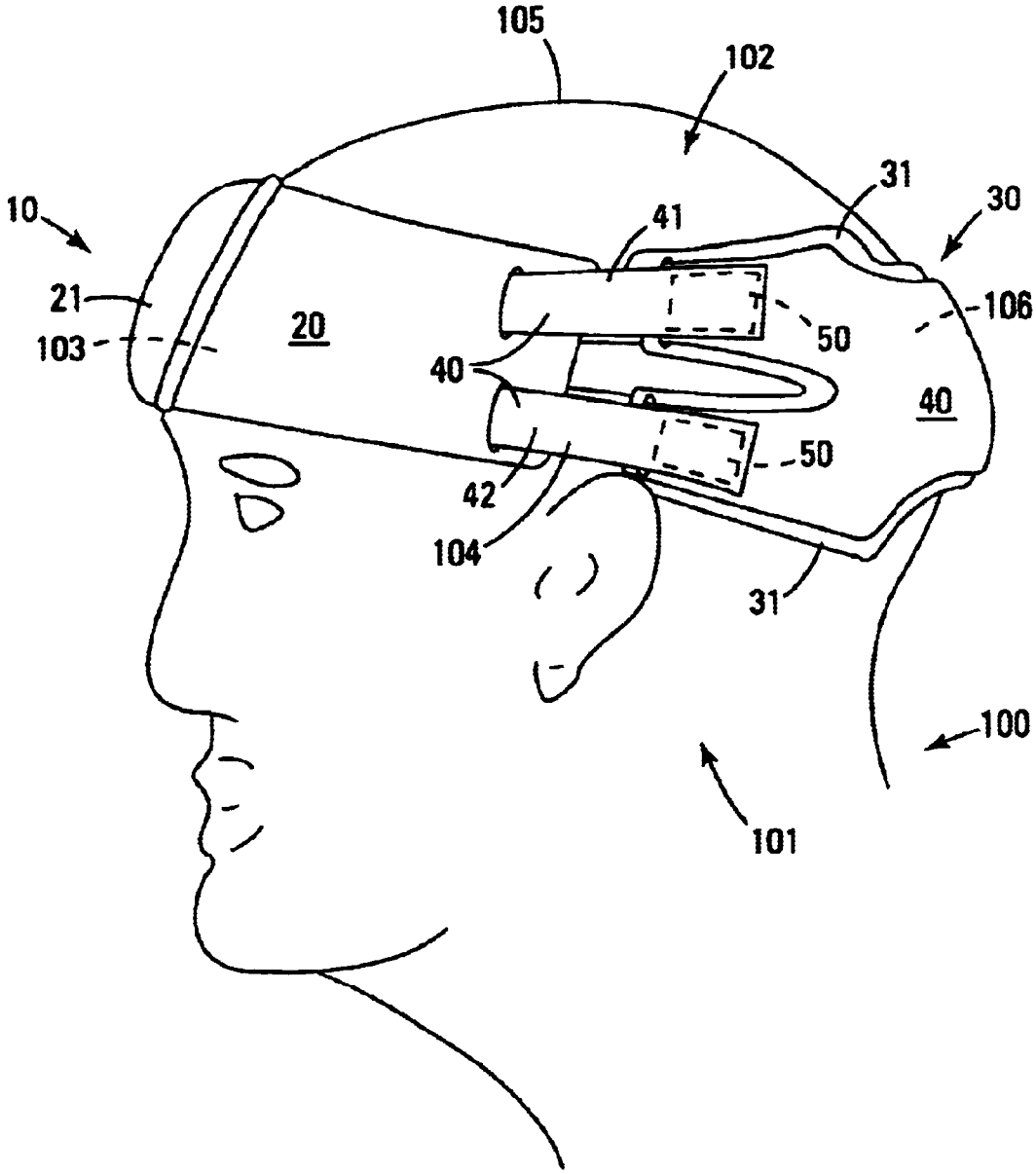
FIG. 15 is a side view of a fourth embodiment of the headgear worn by a wearer including the rear panel shown in FIGS. 12–14.

As shown in FIGS. 12–14, rear panel 30 can be configured with an upper opening 38 and a lower opening 39. This enhances the fit of the rear panel 30 upon a wearer 100 with a ponytail (not shown) as the wearer 100 can run the ponytail 110 through either of the openings 38 or 39 dependent upon the position of the ponytail.

The front panel 20 and rear panel 30 are connected by an adjustable adjustment strap system 40. There are several alternative embodiments and configurations for the adjustment strap system 40.

By way of example, FIGS. 1, 10, 11, 12 and 15 shown slots (unnumbered) molded completely through the front panel 20 and/or the rear panel 30. Adjustable straps 41 and 42 can be passed through the slots with the distal ends (unnumbered) attach to themselves, such as shown in the FIGS., or alternatively attached to some other part of the headguard 10, such as the exterior surface of the rear panel 30.

The adjustment strap system 40 preferably includes an upper adjustment strap 41 and a lower adjustment strap 42.

Figure 11:
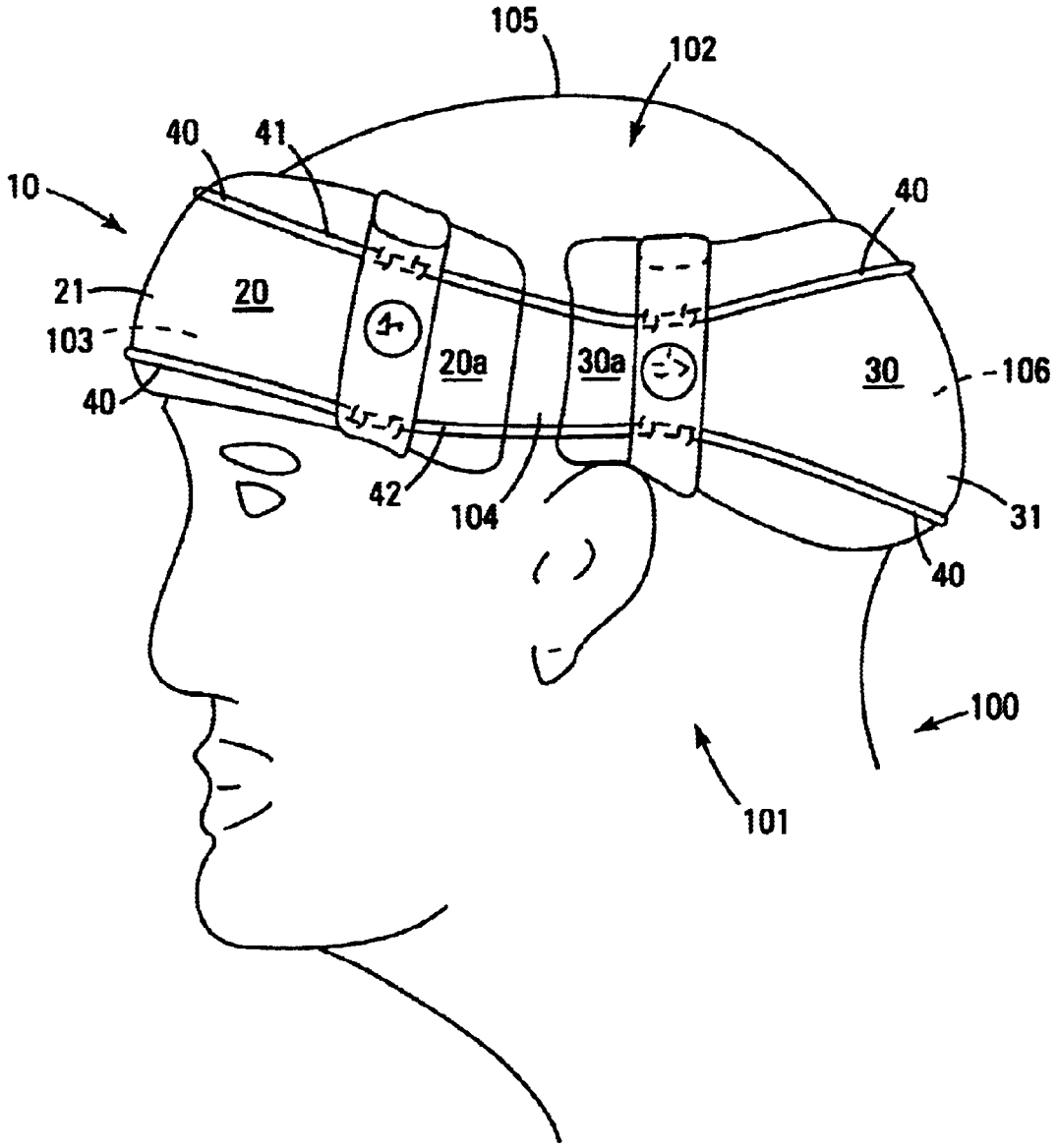
FIG. 11 is a side view of a third embodiment of the headgear.

The adjustment strap system 40 preferably has straps 41 and/or 42 which encircle substantially the entire head 101 of a wearer 100 as shown in FIGS. 1 and 11. Complete encirclement of the head with the adjustment straps 41 and/or 42 promotes the even application of pressure generated by the adjustment straps 41 and/or 42 across a greater surface area of a wearer's head 101. Moreover, when both adjustment straps 41 and 42 encircle the head 101 of a wearer 100, tension is maintained from both a point below the occipital bone (unnumbered) to a point below the frontal bone (unnumbered), and a point above the occipital bone to a point above the frontal bone. This improves comfort, fit, retention, and protection.

Adjustment straps 41 and 42 which completely encircle the head may be made adjustable in any of the wide variety of ways well known to those skilled in the art. By way of example, the ends of each adjustment strap 41 and 42 may be passed through an opening (not shown) in a fastener 90 having a spring-loaded plunger (not shown) biased so as to be effective for securely griping both ends of the strap 41 or 42 passing through the fastener when the plunger is released.

Figure 10:
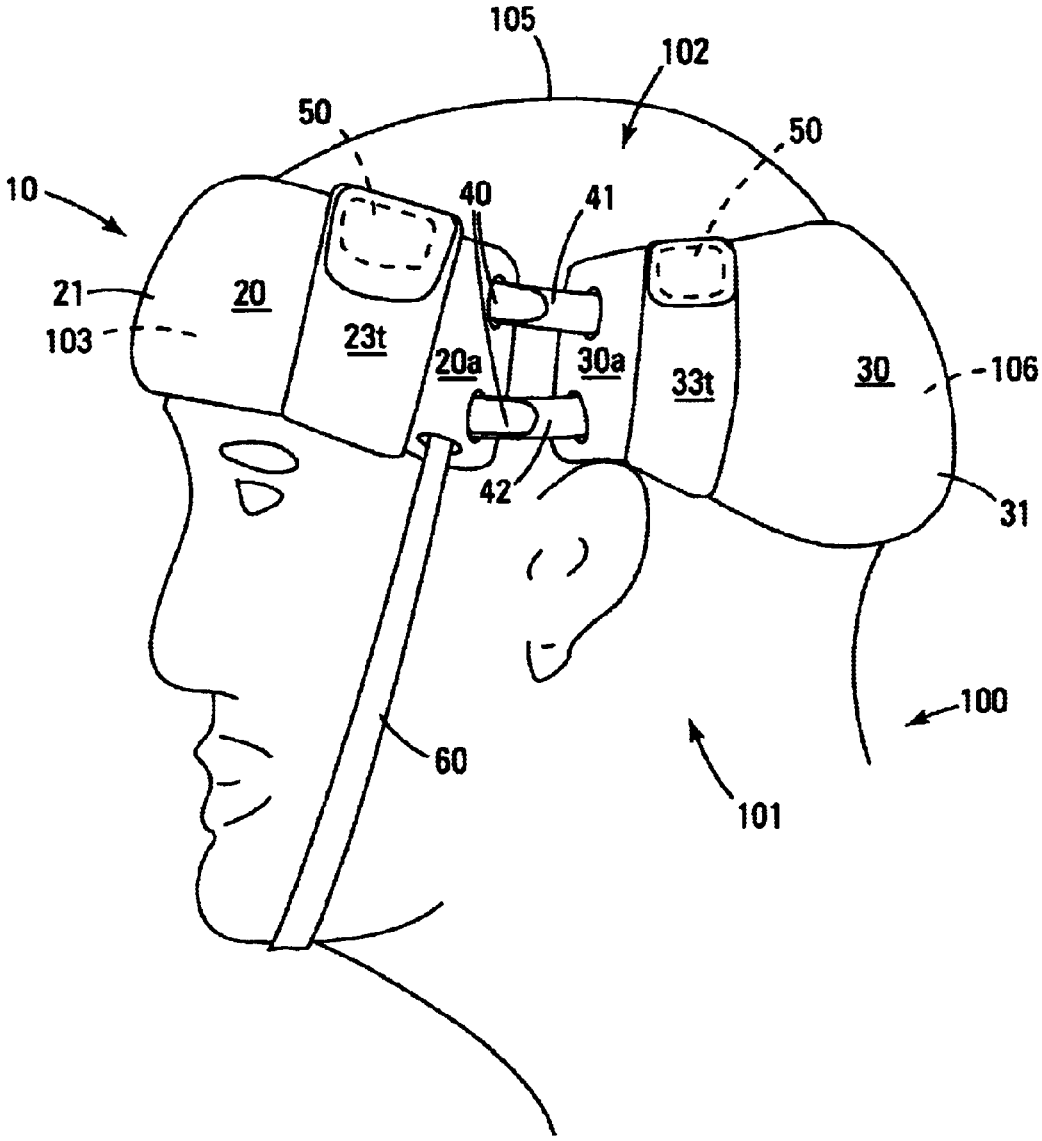
FIG. 10 is a side view of a second embodiment of the headgear.

Alternatively, as shown in FIGS. 10, 11 and 12, the adjustment straps 41 and/or 42 may extend over only a portion of a wearer's head 101. For example, a single adjustment strap 40, with two laterally opposed upper arms 41 and two laterally opposed lower arms 42, may be secured to the rear panel 30 with the arms 41 and 42 passing through corresponding slots (unnumbered) in the front panel 20 and the rear panel 30 proximate the lateral ends 20*a* and 30*a* of each panel. Hook and loop tape 50 can be provided on the arms 41 and 42 for fastening the arms 41 and 42 together and forming a closed loop.

Adjustment straps 41 and 42 encircling only a portion of a wearer's head 101 can maintain the two previously described lines of tension from the above and below the occipital bone to above and below the frontal bone. In such an instance the tension is created by pulling the front 20 and rear 30 panels to cause them to cup around the frontal and occipital bones.

The straps 41 and 42 may be constructed for any of a wide variety of materials well known to those skilled in the art. A preferred material is neoprene.

A gap (unnumbered) often exists between the lateral ends 20*a*, 20*b*, 30*a* and 30*b* of the front panel 20 and the rear panel 30 respectively. These gaps may be positioned at any of a variety of locations on a wearer's head 101, but are preferably positioned over an area of a wearer's head 101 which is least susceptible to injury or trauma from a fall to the ground. As shown in FIGS. 1 and 10, it is generally desirable to position the gaps over or just forward of a wearer's ears 110. Falls to the side are generally less frequent and of lesser force that falls forward or backward, where a wearer's head can be "whipped" against the ground.

To avoid the issues resulting from the existence of gaps between the lateral ends 20*a*, 20*b*, and 30*a*, 30*b* of the front panel 20 and the rear panel 30 respectively, the lateral ends 20*a*, 20*b*, and 30*a*, 30*b* may be overlapped as shown in FIG. 1. However, the additional bulk created by such an overlap must be considered. Alternatively, the headguard 10 may be constructed so that only the lateral ends (unnumbered) of the front and rear shells 21 and 31 overlap.

The present invention should not be considered limited to the particular examples described above, but rather should be understood to cover all aspects of the invention as fairly set out in the attached claims. For example, while suitable materials, fasteners, and the like have been disclosed in the above discussion, it should be appreciated that these are provided by way of example and not of limitation as a number of other materials, fasteners, and so forth may be used without departing from the invention. Various modifications as well as numerous structures to which the present invention may be applicable will be readily apparent to those of skill in the art to which the present invention is directed upon review of the present specifications. The claims are intended to cover such modifications and structures.

I claim:

1. A protective headguard, comprising:

(a) a front panel having first and second lateral ends and comprising layers of at least a shell, a shock absorbing liner and a comfort liner, (b) a rear panel having first and second lateral ends, and (c) a means for releasably connecting the first lateral end of the front panel and the first lateral end of the rear panel, and releasably connecting the second lateral end of the front panel and the second lateral end of the rear panel, (d) wherein connection of the lateral ends forms a protective headguard configured and arranged to cover at least a wearer's forehead and occipital bone while devoid of any covering over a crown portion of a wearer's head when the headguard is worn.

2. The headguard of claim 1 wherein the shock absorbing liner is positioned intermediate the shell and the comfort liner.

3. The headguard of claim 1 wherein the front panel covers at least a portion of both sides of a wearer's head when the headguard is worn.

4. The headguard of claim 2 wherein the comfort liner is releasably connected to the shock absorbing liner.

5. The headguard of claim 2 wherein the shock absorbing liner is releasably connected to the shell.

6. The headguard of claim 1 wherein the connecting means is an adjustable adjustment strap system.

7. The headguard of claim 6, wherein (i) the front panel has an upper portion and a lower portion, (ii) the rear panel has an upper portion and a lower portion, and (iii) the adjustment strap system includes an upper adjustment strap interconnecting an upper portion of the rear panel and an upper portion of the front panel, and a lower adjustment strap interconnecting a lower portion of the rear panel and a lower portion of the front panel.

8. The headguard of claim 6, wherein (i) the front panel has an upper portion and a lower portion, (ii) the rear panel has an upper portion and a lower portion, and (iii) the adjustment strap system includes (A) a pair of upper adjustment straps with a first upper adjustment strap interconnecting an upper portion of the front panel and an upper portion of the rear panel proximate the first lateral ends of the front panel and the rear panel, and a second upper adjustment strap interconnecting an upper portion of the front panel and an upper portion of the rear panel proximate the second lateral ends of the front panel and the rear panel, and (B) a pair of lower adjustment straps with a first lower adjustment strap interconnecting a lower portion of the front panel and a lower portion of the rear panel proximate the first lateral ends of the front panel and the rear panel, and a second lower adjustment strap interconnecting a lower portion of the front panel and a lower portion of the rear panel proximate the second lateral ends of the front panel and the rear panel.

9. The headguard of claim 1 wherein the first and second lateral ends of the front and rear panels overlap when the headguard is worn by a wearer.

10. The headguard of claim 1 wherein the shock absorbing liner of the front panel contains a gel.

11. The headguard of claim 1 wherein the shock absorbing liner of the front panel comprises a packet defining a single cell containing a gel.

12. The headguard of claim 11 wherein the packet has walls with a thickness of less than 1 mm.

13. The headguard of claim 11 wherein the packet has walls with a thickness of less than 400 micrometers.

14. The headguard of claim 1 wherein the comfort liner of the front panel defines a pocket into which the shock absorbing liner can be removably inserted.

15. A protective headguard, comprising:

(a) a front panel having first and second lateral ends, (b) a rear panel having first and second lateral ends, and comprising layers of at least a shell, a shock absorbing liner and a comfort liner, and (c) a means for releasably connecting the first lateral end of the front panel and the first lateral end of the rear panel, and releasably connecting the second lateral end of the front panel and the second lateral end of the rear panel, (d) wherein connection of the lateral ends forms a protective headguard configured and arranged to cover at least a wearer's forehead and occipital bone while devoid of any covering over a crown portion of a wearer's head when the headguard is worn.

16. The headguard of claim 15 wherein the shock absorbing liner is positioned intermediate the shell and the comfort liner.

17. The headguard of claim 15 wherein the rear panel covers at least a portion of both sides of a wearer's head when the headguard is worn.

18. The headguard of claim 16 wherein the comfort liner is releasably connected to the shock absorbing liner.

19. The headguard of claim 16 wherein the shock absorbing liner is releasably connected to the shell.

20. The headguard of claim 15 wherein the connecting means is an adjustable adjustment strap system.

21. The headguard of claim 20, wherein (i) the front panel has an upper portion and a lower portion, (ii) the rear panel has an upper portion and a lower portion, and (iii) the adjustment strap system includes an upper adjustment strap interconnecting an upper portion of the rear panel and an upper portion of the front panel, and a lower adjustment strap interconnecting a lower portion of the rear panel and a lower portion of the front panel.

22. The headguard of claim 20, wherein (i) the front panel has an upper portion and a lower portion, (ii) the rear panel has an upper portion and a lower portion, and (iii) the adjustment strap system includes (A) a pair of upper adjustment straps with a first upper adjustment strap interconnecting an upper portion of the front panel and an upper portion of the rear panel proximate the first lateral ends of the front panel and the rear panel, and a second upper adjustment strap interconnecting an upper portion of the front panel and an upper portion of the rear panel proximate the second lateral ends of the front panel and the rear panel, and (B) a pair of lower adjustment straps with a first lower adjustment strap interconnecting a lower portion of the front panel and a lower portion of the rear panel proximate the first lateral ends of the front panel and the rear panel, and a second lower adjustment strap interconnecting a lower portion of the front panel and a lower portion of the rear panel proximate the second lateral ends of the front panel and the rear panel.

23. The headguard of claim 15 wherein the rear panel has a lateral length sufficient to permit the rear panel to touch both ears of a wearer when the headguard is worn.

24. The headguard of claim 15 wherein the first and second lateral ends of the front and rear panels overlap when the headguard is worn by a wearer.

25. The headguard of claim 15 wherein the shock absorbing liner of the rear panel contains a gel.

26. The headguard of claim 15 wherein the shock absorbing liner of the rear panel comprises a packet defining a single cell containing a gel.

27. The headguard of claim 26 wherein the packet has walls with a thickness of less than 1 mm.

28. The headguard of claim 26 wherein the packet has walls with a thickness of less than 400 micrometers.

29. The headguard of claim 15 wherein the comfort liner of the front panel defines a pocket into which the shock absorbing liner can be removably inserted.

30. A protective headguard, comprising:

(a) a front panel having first and second lateral ends and comprising layers of at least a shell, an intermediate shock absorbing liner and a comfort liner, (b) a rear panel having first and second lateral ends and comprising layers of at least a shell, an intermediate shock absorbing liner and a comfort liner, and (c) a means for releasably connecting the first lateral end of the front panel and the first lateral end of the rear panel, and releasably connecting the second lateral end of the front panel and the second lateral end of the rear panel, (d) wherein connection of the lateral ends forms a protective headguard configured and arranged to cover at least a wearer's forehead and occipital bone while devoid of any covering over a crown portion of a wearer's head when the headguard is worn.

31. The headguard of claim 30 wherein the shock absorbing liner on both the front panel and the rear panel is positioned intermediate the shell and the comfort liner.

32. The headguard of claim 30 wherein at least one of the front panel or the rear panel covers at least a portion of both sides of a wearer's head when the headguard is worn.

33. The headguard of claim 31 wherein the comfort liner is releasably connected to the shock absorbing liner.

34. The headguard of claim 31 wherein the shock absorbing liner is releasably connected to the shell.

35. The headguard of claim 30 wherein the connecting means is an adjustable adjustment strap system.

36. The headguard of claim 35, wherein (i) the front panel has an upper portion and a lower portion, (ii) the rear panel has an upper portion and a lower portion, and (iii) the adjustment strap system includes an upper adjustment strap interconnecting an upper portion of the rear panel and an upper portion of the front panel, and a lower adjustment strap interconnecting a lower portion of the rear panel and a lower portion of the front panel.

37. The headguard of claim 35, wherein (i) the front panel has an upper portion and a lower portion, (ii) the rear panel has an upper portion and a lower portion, and (iii) the adjustment strap system includes (A) a pair of upper adjustment straps with a first upper adjustment strap interconnecting an upper portion of the front panel and an upper portion of the rear panel proximate the first lateral ends of the front panel and the rear panel, and a second upper adjustment strap interconnecting an upper portion of the front panel and an upper portion of the rear panel proximate the second lateral ends of the front panel and the rear panel, and (B) a pair of lower adjustment straps with a first lower adjustment strap interconnecting a lower portion of the front panel and a lower portion of the rear panel proximate the first lateral ends of the front panel and the rear panel, and a second lower adjustment strap interconnecting a lower portion of the front panel and a lower portion of the rear panel proximate the second lateral ends of the front panel and the rear panel.

38. The headguard of claim 30 wherein the rear panel has a lateral length sufficient to permit the rear panel to touch both ears of a wearer when the headguard is worn.

39. The headguard of claim 30 wherein the first and second lateral ends of the front and rear panels overlap when the headguard is worn by a wearer.

40. The headguard of claim 30 wherein the shock absorbing liner of the front panel and the rear panel contains a gel.

41. The headguard of claim 30 wherein the shock absorbing liner of at least one of the front panel and the rear panel comprises a packet defining a single cell containing a gel.

42. The headguard of claim 41 wherein the packet has walls with a thickness of less than 1 mm.

43. The headguard of claim 41 wherein the packet has walls with a thickness of less than 400 micrometers.

44. The headguard of claim 30 wherein the comfort liner of the front panel defines a pocket into which the shock absorbing liner can be removably inserted.

* * * * *